US011225395B2

(12) United States Patent
Meier et al.

(10) Patent No.: US 11,225,395 B2
(45) Date of Patent: Jan. 18, 2022

(54) ARRANGEMENT FOR EVACUATING PERSONS FROM AN ELEVATOR CAR

(71) Applicant: Inventio AG, Hergiswil (CH)

(72) Inventors: Daniel Meier, Emmenbrücke (CH); Gerardino Colatrella, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 542 days.

(21) Appl. No.: 16/090,297

(22) PCT Filed: Apr. 6, 2017

(86) PCT No.: PCT/EP2017/058281

§ 371 (c)(1),
(2) Date: Oct. 1, 2018

(87) PCT Pub. No.: WO2017/174739

PCT Pub. Date: Oct. 12, 2017

(65) Prior Publication Data

US 2019/0112154 A1 Apr. 18, 2019

(30) Foreign Application Priority Data

Apr. 7, 2016 (EP) ..... 16164307

(51) Int. Cl.
*B66B 5/02* (2006.01)
*B66B 11/02* (2006.01)

(52) U.S. Cl.
CPC ..... *B66B 5/027* (2013.01); *B66B 5/028* (2013.01); *B66B 11/0226* (2013.01)

(58) Field of Classification Search
CPC ..... B66B 5/027; B66B 11/0226
See application file for complete search history.

(56) References Cited

FOREIGN PATENT DOCUMENTS

| | | | | | |
|---|---|---|---|---|---|
| JP | 10087204 | A | * | 4/1998 | |
| JP | 2004123315 | A | | 4/2004 | |
| JP | 2005067881 | A | | 3/2005 | |
| JP | 2005154025 | A | | 6/2005 | |
| JP | 2007153540 | A | | 6/2007 | |
| JP | 2008050152 | A | * | 3/2008 | |
| JP | 2008050152 | A | | 3/2008 | |
| JP | 2012082061 | A | | 4/2012 | |
| JP | 2014114081 | A | * | 6/2014 | |
| KR | 20150145702 | A | | 12/2015 | |
| WO | WO-2019026291 | A1 | * | 2/2019 | ..... B66B 5/00 |

OTHER PUBLICATIONS

Machine Translation of JP 2005-154025.*

* cited by examiner

*Primary Examiner* — Diem M Tran
(74) *Attorney, Agent, or Firm* — William J. Clemens; Shumaker, Loop & Kendrick, LLP

(57) ABSTRACT

An arrangement for evacuating persons from an elevator car includes a tread element, which tread element delimits a lower end of an evacuation passage of the elevator car, and a walkway having a first end, wherein the walkway can be fixed, preferably hooked, on the tread element by the first end. The arrangement includes at least one rung that can be fixed above the tread element, wherein the rung is usable as a tread step and the first end of the walkway can alternatively be fixed or hooked on the rung instead of on the tread element.

19 Claims, 4 Drawing Sheets

ARRANGEMENT FOR EVACUATING PERSONS FROM AN ELEVATOR CAR

FIELD

The invention relates to an apparatus for evacuating persons from an elevator car, to an elevator system comprising an apparatus of this type, and to a method for evacuating persons from this elevator car.

BACKGROUND

Elevator systems comprise at least one elevator car, which is arranged in an elevator shaft so as to be vertically movable, usually along guide rails, in order to convey persons or goods between two floors. Elevator systems of this type are continuously subjected to maintenance during operation in order to ensure the safety of the persons being conveyed and of the elevator system. Nevertheless, it is possible for the operation of the elevator installation to be interrupted as a result of external influences or defective components of the elevator installation. For example, power cuts, lightning strikes, or a safety circuit of the elevator system being interrupted may lead to the elevator car, with persons traveling therein, becoming stuck between two floors. It is then necessary for the persons stranded in the elevator car to be evacuated from the elevator car.

JP2005-154025A discloses an evacuation apparatus for evacuating persons when two elevator cars are arranged so as to move beside one another in an elevator shaft in normal operation. If a first of these two elevator cars becomes stranded in the elevator shaft, the second elevator car is positioned next to the first elevator car. Evacuation passages in the two elevator cars that face one another can be opened. These evacuation passages can be connected by a walkway or evacuation walkway, it being possible for said evacuation walkway to be fastened to the lower boundary of each evacuation passage. To evacuate the first elevator car, the persons to be evacuated cross the evacuation walkway in order to reach the second elevator car, which can still move.

In order to fasten the guide rails of the two elevator cars, it is common practice to arrange horizontally extending fastening supports at regular intervals between the travel paths of the two elevator cars. The drawback is that, when evacuating the first elevator car, a fastening support of this type may prevent the persons to be evacuated from reaching the second elevator car without any obstacles when passing over the walkway. This would be the case if the fastening support was arranged right in front of the evacuation passage.

SUMMARY

The problem addressed by the invention is therefore to increase the safety of persons to be evacuated from an elevator car.

The problem is solved by means of an apparatus for evacuating persons from an elevator car, preferably comprising the elevator car, a tread element, which tread element defines a lower end of an evacuation passage in the elevator car, and a walkway comprising a first end, it being possible to attach, preferably hook, the walkway onto the tread element by means of the first end, wherein the apparatus comprises at least one rung that can be attached above the tread element, the rung being designed/used as a step, and it being possible to alternatively attach or hook the first end of the walkway onto the rung rather than onto the tread element.

The problem is likewise solved by means of an elevator system comprising an apparatus of this type.

The problem is likewise solved by means of a method for evacuating persons from an elevator car comprising an apparatus of this type, wherein the first end of the walkway is attached or hooked onto the rung.

An evacuation passage of this type is an opening in the elevator car provided for evacuating persons, and can for example be arranged in a side wall of the elevator car or in the balustrade positioned on the car roof. During normal operation for conveying persons, the persons to be conveyed cannot pass through an evacuation opening of this type.

The invention is based on the knowledge that an evacuation from the level of the car floor of the elevator car to be evacuated can be made very difficult by the existing vertical position of the stuck elevator car to be evacuated in the elevator shaft. This is due to fastening supports for guide rails or other elements arranged in the elevator shaft which may be arranged right at the evacuation passage of this stuck elevator car, i.e. this car which is substantially stationary in the vertical direction. It is however desirable for said fastening supports or elements not to hinder this kind of evacuation such that they constitute an obstacle for the persons to be evacuated.

To achieve this, the evacuation opening for evacuating the persons is modified such that the vertical height of a walkway which can be arranged on the stuck elevator car for evacuation from the stuck elevator car can be adapted to the conditions within the elevator shaft. Accordingly, the apparatus comprises at least one rung that can be fastened in the evacuation passage, to which rung the walkway, i.e. the evacuation walkway, can be attached. Therefore, the walkway can be arranged on the elevator car to be evacuated or on the evacuation passage of the elevator car at different height positions. If necessary, the uppermost rung to which the walkway can advantageously be fastened for evacuation under the given circumstances is a relatively large distance from the tread element. In such a case, at least one additional rung can be arranged between the uppermost rung and the tread element. In order to meet the relevant safety requirements, at least one handrail may be fastened to the walkway in its longitudinal direction. A handrail of this type can minimize the risk of persons falling into the elevator shaft when crossing the walkway.

A development of the apparatus involves a bar that is attached to the elevator car beside the evacuation passage, it being possible to attach the at least one rung to the bar. A bar of this type allows for fixed spacing between the at least one safety rung and the tread element, and thus allows for increased safety when passing over the evacuation apparatus.

The apparatus may comprise a second bar, it being possible to fasten the bars either side of an evacuation passage in the elevator car and to attach the at least one rung to the second bar. A second bar of this type makes it possible to securely anchor every rung on either side of the evacuation passage.

In a development of the apparatus, the bar(s) is/are arranged perpendicularly to the tread element. This allows the apparatus to be positioned on the elevator car in a simple and compact manner.

The bar(s) may be part of a balustrade arranged on a car roof of the elevator car. Evacuation via the car roof of the elevator car to be evacuated is one option for evacuating persons from the interior of the elevator car or from the elevator car to be evacuated. It is for example possible to reach the evacuation passage by substantially vertically departing from the interior of the elevator car onto the corresponding car roof. For example, during maintenance work carried out by a service technician on said car roof, this evacuation opening in the balustrade is preferably not passable.

Alternatively, the bar(s) can be arranged either side of an evacuation passage formed as an evacuation door. An evacuation door of this type can be directly arranged in a side wall of the elevator car. Therefore, the persons to be evacuated can step directly onto the walkway from the interior of the elevator car. During normal operation for conveying persons, the persons to be conveyed cannot pass through an evacuation opening of this type that is formed as an evacuation door.

A development of the apparatus involves a safety barrier comprising a safety contact, which safety barrier can be arranged within the evacuation passage such that the safety barrier obstructs the evacuation passage in its fixed position, and the safety contact is only closed in the fixed position of the safety barrier. In order for persons to safely depart from the elevator car to be evacuated, the evacuation passage is only opened when the safety contact is open, i.e. when a safety circuit is open. Only when the safety circuit is closed is it possible for the elevator car to be moved by a service technician, if necessary. Preferably, the safety circuit of this elevator car on which a removable safety barrier is arranged can be opened by removing this safety barrier.

Advantageously, the safety barrier is in the form of a rod and can be attached above the at least one rung. This can ensure that, irrespective of the position of the rung to which the walkway is attached, the evacuation passage is always blocked provided that the safety barrier closes the safety contact.

In an alternative embodiment, the safety barrier can substantially completely close the evacuation passage in its fixed position. For example, a safety barrier of this type that closes the evacuation passage in its fixed position can be formed by the door leaf of the evacuation door in its closed position. In this way, the safety of the persons to be evacuated can be increased.

A development of the elevator system involves an additional elevator car, the additional elevator car comprising an additional evacuation passage allocated to the additional elevator car, it being possible to connect the evacuation passage in the elevator car and the evacuation passage in the additional elevator car by means of the walkway. The additional, i.e. second, elevator car can therefore be arranged substantially beside the elevator car to be evacuated. Preferably, these two evacuation passages in the two elevator cars face one another. By passing over the walkway, the persons can leave the stuck elevator car and enter the operational elevator car.

In a development of the elevator system, a lower end of the evacuation passage in the additional elevator car is defined by a second tread element, wherein the walkway can be attached, preferably hooked, onto the tread element by means of its second end, and an additional rung can be attached above the second tread element, wherein the additional rung is designed/used as a step, and a second end of the walkway can alternatively be attached or hooked onto the rung rather than onto the tread element. If the additional, i.e. second, elevator car becomes stuck in the elevator shaft, it is advantageous for it to be possible for the persons to be evacuated by means of the first elevator car.

DESCRIPTION OF THE DRAWINGS

The invention is described in greater detail in the following with reference to the drawings, in which.

DETAILED DESCRIPTION

Figure 1:
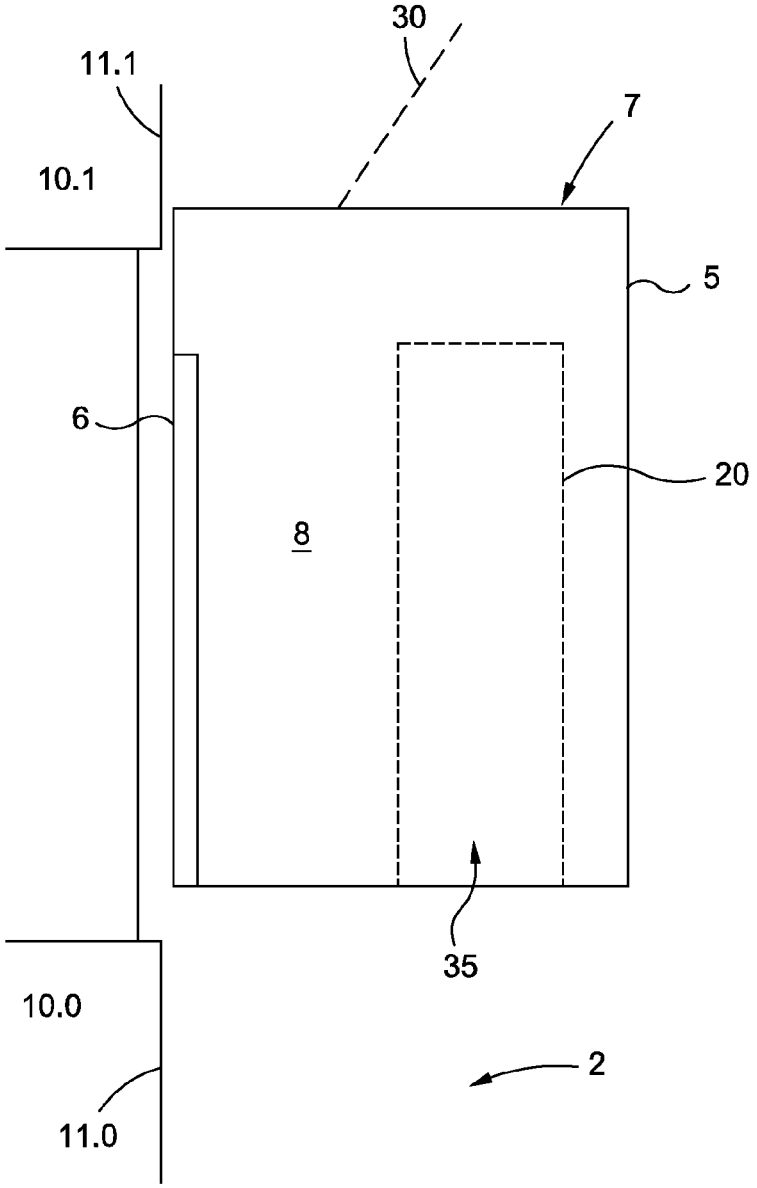
FIG. 1 shows an elevator car stuck in an elevator shaft, and shows an elevator system comprising an apparatus for evacuating persons.

FIG. 1 shows an elevator car 5 of an elevator system that is stuck in an elevator shaft 2. The elevator shaft 2 is adjacent to two floors 10.0, 10.1 arranged one immediately above the other. Each of these floors 10.0, 10.1 has a shaft door 11.0, 11.1. During normal operation, when the elevator car 5 is not stuck, elevator passengers can enter and leave the elevator car 5 through a car door 6 of the elevator car 5 and the shaft door 11.0, 11.1 at which the elevator car 5 is positioned when it is stopped at a floor.

The elevator car 5, when stuck according to FIG. 1, is arranged between two floors 10.0, 10.1 arranged one immediately above the other. This means that the interior of the elevator car 5 cannot be reached through one of the shaft doors 11.0, 11.1 from one of the floors 10.0, 10.1. In the same way, instead, the elevator car 5 could equally be arranged at one of the shaft doors 11.0, 11.1, whereas the car door 6 or the shaft door 11.0, 11.1 at which shaft door 11.0, 11.1 the elevator car 5 is arranged is stuck in the closed position. Accordingly, the persons inside the elevator car 5 cannot leave the elevator car 5 through the car door 6 or through one of the shaft doors 11.0, 11.1.

In order for it to be possible to evacuate the passengers inside the elevator car 5, the elevator car 5 comprises an evacuation passage 35. For example, an exit from the elevator shaft 2 can be reached via this evacuation passage 35 of the elevator car 5.

The evacuation passage 35 is formed as an evacuation door 20. An evacuation door 20 of this type is arranged in one of the side walls 8 of the elevator car 5 and, for example, can only be opened from the outside so that a service technician can safely evacuate the persons from the stuck elevator car 5.

Alternatively or additionally, the elevator car 5 may comprise an evacuation passage 35 arranged on the car roof 7 of the elevator car 5. An evacuation passage of this type arranged on the car roof 7 can be reached through a roof hatch 30 in the car roof 7 by means of a ladder which can be temporarily arranged in the elevator car 5, for example.

Figure 2:
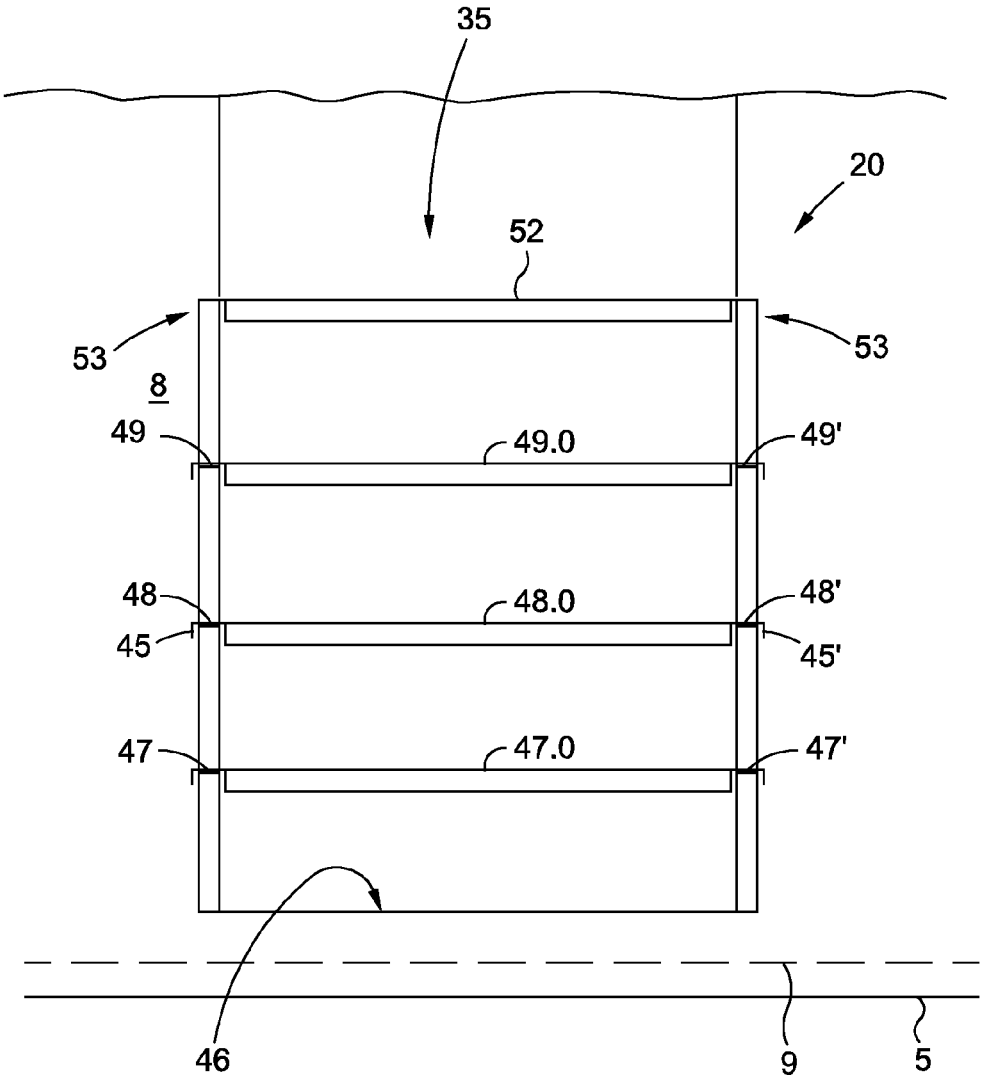
FIG. 2 shows an evacuation passage that is arranged in one of the side walls of the elevator car and is formed as an evacuation door.
Figure 3:
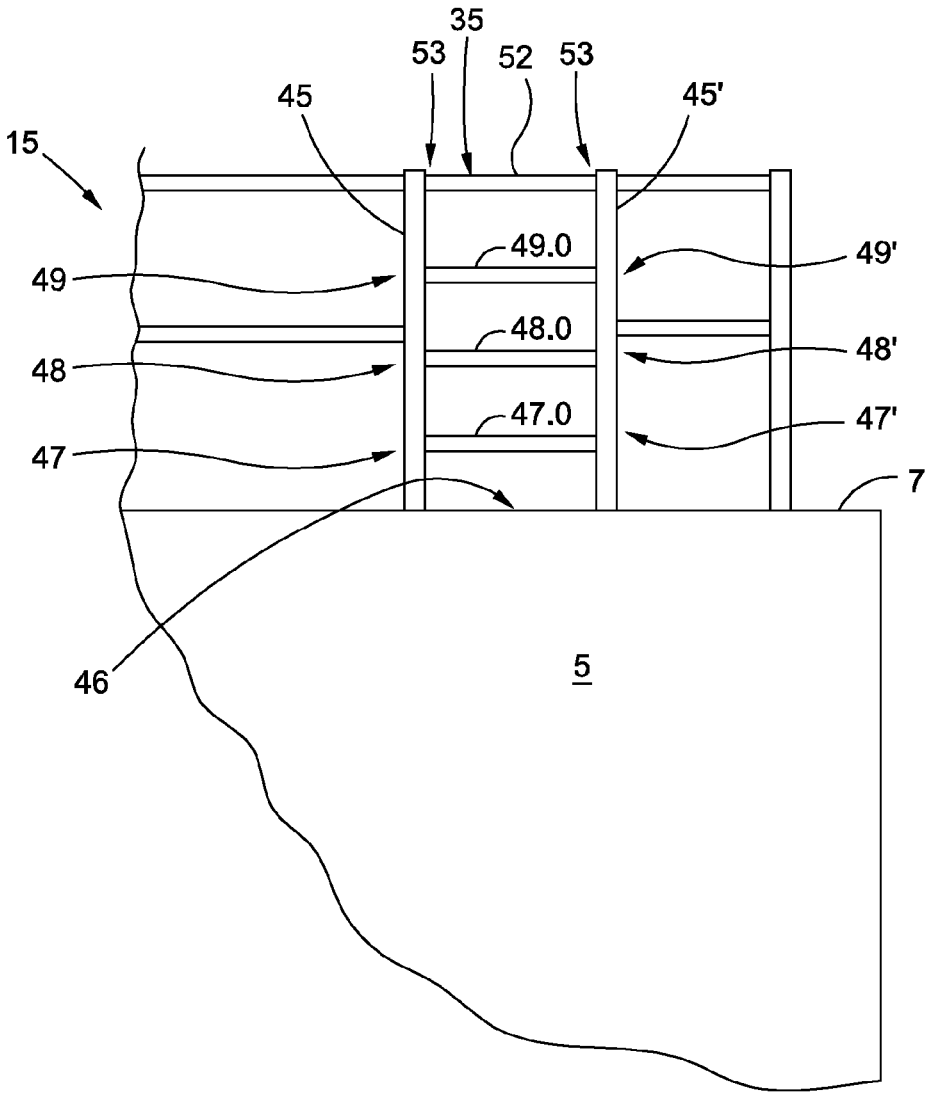
FIG. 3 shows an evacuation passage arranged on the car roof in the form of an integral component of a balustrade.

FIG. 2 shows an evacuation passage 35 that is formed as an evacuation door 20 and is arranged in one of the side walls 8 of the elevator car 5. FIG. 3 shows parts of an apparatus for evacuating persons, which parts are formed as integral components of a balustrade 15 arranged on the car roof 7.

Components of an apparatus for evacuating persons are arranged at the evacuation passages 35 shown in FIGS. 2 and 3. A lower end of the evacuation passage is defined by a tread element 46 of the apparatus. The tread element 46 can be used as a first step, i.e. for entry, or can be used for hooking on or attaching a walkway, i.e. an evacuation walkway (not shown in FIGS. 2 and 3). The apparatus comprises at least one rung 47.0, 48.0, 49.0, and the rung 47.0, 48.0, 49.0 can be attached above the tread element 46. An uppermost element of the elements attached in the evacuation passage 35 during the evacuation, including the at least one attached rung 47.0, 48.0, 49.0 and the tread element 46, is used to attach the walkway during an evacuation. Preferably, these elements, which are arranged one immediately above the other, are at a vertical spacing in the range of from 20 to 30 cm, preferably 26 cm.

In order for it to be possible to arrange said at least one rung 47.0, 48.0, 49.0 within the evacuation passage, a bar 45 may be arranged beside the door opening. The bar 45 comprises a fastening region 47, 48, 49 allocated to the relevant rung 47.0, 48.0, 49.0 for attaching the rung(s) 47.0, 48.0, 49.0 in the evacuation passage. The bar 45, which is preferably oriented perpendicularly on the tread element 46, can be attached to the side wall 8 of the elevator car 5 comprising the evacuation passage or to the balustrade 15 such that a component of a door frame or a component of the balustrade 15 is formed by the bar 45 for the evacuation passage.

A second bar 45' can be arranged on the other side of the evacuation passage relative to the first bar 45 and can be formed in the same way as said first bar 45. Accordingly, the second bar 45' comprises a fastening region 47', 48', 49' allocated to the relevant rung 47.0, 48.0, 49.0 for attaching the rung(s) 47.0, 48.0, 49.0, the fastening region 47', 48', 49' preferably being arranged such that the rung(s) 47.0, 48.0, 49.0 are oriented horizontally in the evacuation passage.

Furthermore, a safety barrier 52 may be arranged within the evacuation passage such that the evacuation passage is obstructed despite the evacuation door or balustrade 15 being open. The safety barrier 52 shown in FIGS. 2 and 3 is in the form of a rod. The safety barrier 52 providing an obstruction is attached to the at least one bar 45, 45' and/or above all the fastening regions 47, 48, 49, 47', 48', 49' of the apparatus that can be allocated to the rungs 47.0, 48.0, 49.0. The safety barrier 52 comprises a safety contact 53 which is preferably closed in the position in which the safety barrier 52 obstructs the evacuation passage. Removing said safety barrier 52 causes the safety contact 53 to be activated, and therefore the evacuation passage is opened. The safety contact 53 may for example be integrated in a safety circuit of the elevator system, with an open safety circuit preventing the elevator car to which the safety circuit is allocated from moving.

The tread element 46 shown in FIG. 2 is preferably arranged above a plane of the car floor 9 of the elevator car 5, such that the car floor 9 resembles the bottom of a trough.

Figure 4:
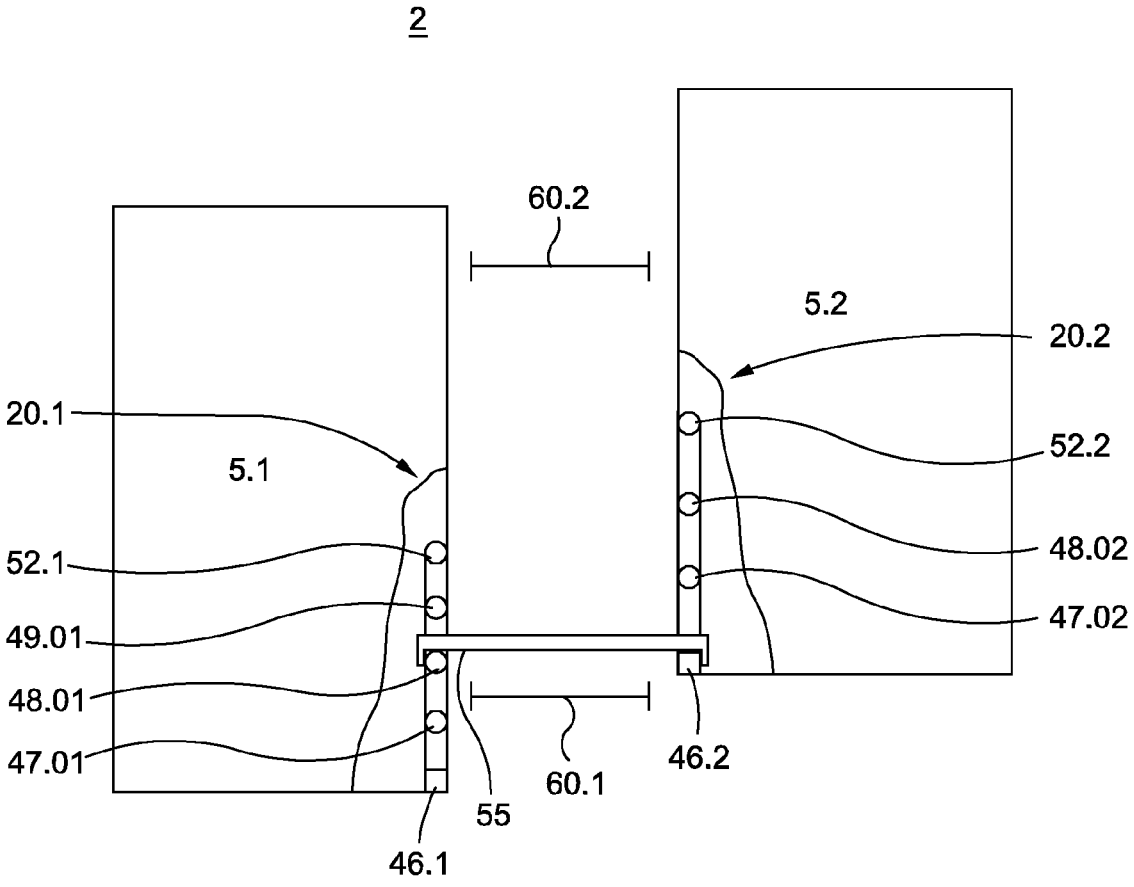
FIG. 4 shows an elevator system comprising an apparatus for evacuating persons from an elevator car.

FIG. 4 shows an elevator system comprising a first elevator car 5.1 and a second elevator car 5.2, which two elevator cars 5.1, 5.2 are arranged beside one another in a shared elevator shaft 2. Both the first and the second elevator car 5.1, 5.2 comprise an evacuation door 20.1, 20.2. The first evacuation door 20.1 allocated to the first elevator car 5.1 and the second evacuation door 20.2 allocated to the second elevator car 5.2 face one another. An apparatus as shown in FIG. 2 for evacuating persons is or can be arranged on each of the two evacuation doors 20.1, 20.2, as shown in FIG. 4. Alternatively, an apparatus as shown in FIG. 3 may be arranged on the respective balustrades of the two elevator cars.

Accordingly, a first of the two apparatuses is arranged on the first evacuation door 20.1 and the second of these apparatuses is arranged on the second evacuation door 20.2. A plurality of fastening supports 60.1, 60.2 arranged vertically one above the other are arranged in the elevator shaft 2 between the travel paths of the two elevator cars 5.1, 5.2. Rails (not shown) for vertically guiding the elevator cars 5.1, 5.2 in the elevator shaft 2 may be fastened to fastening supports 60.1, 60.2 of this type.

By way of example, the first elevator car 5.1 is stuck in the elevator shaft 2, while the second elevator car 5.2 can still move vertically. This means that it is not possible for the first elevator car 5.1 to move vertically, and as a result the persons inside the first elevator car 5.1 need to be evacuated. The first elevator car 5.1 becoming stuck in this way may be caused, inter alia, by a power cut, a lightning strike, or a defective shaft-door contact that opens the safety circuit despite the shaft door comprising this shaft-door contact being closed. The second elevator car 5.2 can thus be positioned in the elevator shaft 2 such that the persons can be evacuated from the first stuck elevator car 5.1 into the second elevator car 5.2 via a walkway 55 that can be attached to the two apparatuses.

A first end of the walkway 55 is attached or hooked onto a rung 48.01 of a first of the two apparatuses, and the second end thereof opposite the first end is attached or hooked onto the tread element 46.2 of the second of the two apparatuses such that the distance over the walkway 55 to be crossed by the persons to be evacuated is kept as short as possible. It is understandable for this crossing distance to be limited irrespective of the vertical positioning of the second elevator car 5.2 if the walkway 55 were to be attached or hooked onto the tread elements 46.1, 46.2 of the two apparatuses since, when crossing the walkway 55, the persons would have to step over or crawl through the lower of the two fastening supports 60.1 shown in FIG. 4, which in turn would entail a higher risk of the persons falling into the elevator shaft 2.

This means that the second elevator car 5.2 can be positioned in the elevator shaft 2 for evacuation relative to the first, stuck elevator car 5.1 depending on the position of the fastening support 60.1 hindering evacuation. Once the second evacuation door has been opened, the service technician evacuating the persons can remove the safety barrier 52.2 of the second apparatus in order to thus open the safety contact allocated to the second elevator car 5.2 or interrupt the allocated safety circuit. It is also possible to design the safety contact of this safety barrier 52.2 such that the safety circuit allocated to the first elevator car 5.1 is also interrupted in order to securely prevent the first elevator car 5.1 from moving when a power cut comes to an end, for example. If necessary, the first end of the walkway 55 can be attached or hooked onto the tread element 46.1 or onto one of the rungs 47.01, 48.01, 49.01 that are attached within the evacuation passage. A rung 49.01 that can be attached above the first end of the attached walkway 55 if necessary should be removed if at all possible for evacuating the persons in order to avoid said persons having to step over an additional obstacle, which would be constituted by a rung 49.01 of this type. In order to make it possible for the persons to be evacuated to easily cross the walkway 55, the rung 47.01 that can be attached below the first end of the attached or hooked walkway 55 can be attached within the evacuation passage.

A method, described in the following, for evacuating the stuck elevator car 5.1 is applicable both to elevator installations that only comprise the stuck, first elevator car 5.1, and also to elevator installations that also comprise the second elevator car 5.2. In order to carry out the evacuation from the first elevator car 5.1, a service technician has to switch the stuck elevator car 5.1 into a stop mode. This means that the stuck state, which may have been brought about by a power cut or lightning strike, is secured. For example, this can be carried out by activating a master switch in the machine room of the elevator installation. This stuck elevator car 5.1 is thus prevented from moving due to a power supply being externally restored, and therefore a service technician working outside this stuck elevator car 5.1 cannot be surprised or put at risk by a moving elevator car 5.1 that has suddenly become operational again.

The service technician can then gain access to the stuck elevator car 5.1. If necessary, the service technician preferably transfers the second elevator car 5.2 into a service mode such that the second elevator car 5.2 can be positioned in the elevator shaft 2 such that the persons can be evacuated from the stuck elevator car 5.1 into the second elevator car 5.2 via a walkway 55 that can be attached to the two elevator cars 5.1, 5.2. Once the service technician has secured said walkway against the risk of persons falling into the elevator shaft 2, the service technician can remove the safety barrier 52.2 which may be provided on the second elevator car 5.2. The service technician then positions the walkway 55 such that the first end of the walkway 55 is attached or hooked onto the first elevator car 5.1, either onto the tread element 46.1 or onto one of the rungs 47.0, 48.0, 49.0 of the apparatus, in order for the evacuation to be carried out. The second end of the walkway 55 can preferably be attached or hooked onto the tread element 46.2 attached to the second elevator car 5.2. Alternatively, the second end can likewise be attached or hooked onto one of the rungs 47.02, 48.02 attached to the second elevator car 5.2. The second end of the walkway 55 should be attached, if at all possible, to a shaft exit in the elevator shaft 2 if the persons inside the first elevator car 5.1 cannot be evacuated to a second elevator car 5.2 that may be provided. A safety barrier 52.1 can then be removed so as to thus render the walkway 55 accessible to the persons to be evacuated and so as to make it possible to carry out the evacuation.

In the same way, the equipment provided for an elevator system as described according to FIG. 4 is equally suitable for evacuating persons who are inside a stuck, second elevator car 5.2 into a first, movable elevator car 5.1.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An apparatus for evacuating persons from an elevator car comprising:

an elevator car having an evacuation passage;

a tread element forming a step at a lower end of the evacuation passage in the elevator car;

a walkway having a first end and a second end; and at least one rung attached above the tread element to the elevator car, the at least one rung being formed as a step usable by a person evacuating the elevator car, and wherein the first end of the walkway is adapted to be selectively attachable onto the tread element or onto the rung, wherein the walkway is selectively positionable between a first configuration and a second configuration to enable evacuation of the elevator car, where in the first configuration the first end of the walkway is attached onto the tread element, and in the second configuration the first end of the walkway is attached onto the rung.

2. The apparatus according to claim 1 wherein the first end of the walkway is formed as a hook.

3. The apparatus according to claim 1 including a bar attached to the elevator car beside the evacuation passage wherein the at least one rung is adapted to be attached the bar.

4. The apparatus according to claim 3 including a second bar, the first bar and the second bar being fastened to the elevator car on opposite sides of the evacuation passage and the at least one rung being attached to the first bar and the second bar.

5. The apparatus according to claim 4 wherein the first and second bars are arranged perpendicularly to the tread element.

6. The apparatus according to claim 4 wherein the first and second bars and the at least one rung are included in a balustrade arranged on a car roof of the elevator car.

7. The apparatus according to claim 4 wherein the first and second bars are arranged on either side of the evacuation passage formed as an evacuation door.

8. The apparatus according to claim 1 including a safety barrier having a safety contact, the safety barrier being arranged within the evacuation passage such that the safety barrier obstructs the evacuation passage in a fixed position, and the safety contact is only closed in the fixed position of the safety barrier.

9. The apparatus according to claim 8 wherein the safety barrier is formed as a rod attached above the at least one rung.

10. The apparatus according to claim 8 wherein the safety barrier closes the evacuation passage in the fixed position.

11. An elevator system comprising an elevator car and the apparatus for evacuating persons from the elevator car according to claim 1.

12. The elevator system according to claim 11 comprising an additional elevator car, the additional elevator car having an additional evacuation passage, wherein the walkway is adapted to be connected to the evacuation passage in the elevator car and the additional evacuation passage in the additional elevator car.

13. The elevator system according to claim 12 wherein a lower end of the additional evacuation passage in the additional elevator car is formed by a second tread element, wherein the walkway is adapted be attached onto the second tread element by the second end of the walkway, and including an additional rung attached above the second tread element, wherein the additional rung is formed as a step usable by a person evacuating the additional elevator car, wherein the second end of the walkway is further adapted to be attached onto the additional rung, and wherein the second end of the walkway is selectively attachable to one of the second tread element and the additional rung to enable evacuation of the additional elevator car.

14. The elevator system according to claim 13 wherein the first end and the second end of the walkway are each formed as a hook.

15. A method for evacuating persons from an elevator car comprising the steps of: providing the apparatus according to claim 1; and attaching the first end of the walkway onto the at least one rung or the tread element.

16. An apparatus for evacuating persons from an elevator car comprising:

an elevator car having an evacuation passage;

a tread element forming a lower end of the evacuation passage in the elevator car;

a walkway having a first end adapted to be attached onto the tread element;

at least one rung attached above the tread element to the elevator car, the at least one rung being formed as a step usable by a person evacuating the elevator car, and wherein the first end of the walkway is further adapted to be attached onto the rung, wherein the first end of the walkway is selectively attachable to one of the tread element or the rung to enable evacuation of the elevator car; and a first bar and a second bar fastened to the elevator car on opposite sides of the evacuation passage, where the at least one rung is attached to the first bar and the second bar, and wherein the first and second bars and the at least one rung are included in a balustrade arranged on a car roof of the elevator car.

17. An apparatus for evacuating persons from an elevator car comprising:

an elevator car having an evacuation passage;

a tread element forming a lower end of the evacuation passage in the elevator car;

a walkway having a first end adapted to be attached onto the tread element;

at least one rung attached above the tread element to the elevator car, the at least one rung being formed as a step usable by a person evacuating the elevator car, and wherein the first end of the walkway is further adapted to be attached onto the rung, wherein the first end of the walkway is selectively attachable to one of the tread element or the rung to enable evacuation of the elevator car; and a safety barrier having a safety contact, the safety barrier being arranged within the evacuation passage such that the safety barrier obstructs the evacuation passage in a fixed position, and the safety contact is only closed in the fixed position of the safety barrier.

18. The apparatus according to claim 17 wherein the safety barrier is formed as a rod attached above the at least one rung.

19. The apparatus according to claim 17 wherein the safety barrier closes the evacuation passage in the fixed position.

* * * * *